US008834112B2

(12) United States Patent
Fukuda

(10) Patent No.: US 8,834,112 B2
(45) Date of Patent: Sep. 16, 2014

(54) CENTRIFUGAL FAN

(75) Inventor: Takako Fukuda, Nagano (JP)

(73) Assignee: Minebea Co., Ltd., Nagano (JP)

( * ) Notice: Subject to any disclaimer, the term of this patent is extended or adjusted under 35 U.S.C. 154(b) by 421 days.

(21) Appl. No.: 13/311,884

(22) Filed: Dec. 6, 2011

(65) Prior Publication Data

US 2012/0156025 A1 Jun. 21, 2012

(30) Foreign Application Priority Data

Dec. 21, 2010 (JP) ..... 2010-284978

(51) Int. Cl.

| | |
|---|---|
| ***F04D 29/28*** | (2006.01) |
| ***F04D 29/44*** | (2006.01) |
| ***F04D 29/16*** | (2006.01) |
| ***F04D 25/06*** | (2006.01) |

(52) U.S. Cl.

CPC ..... *F04D 29/162* (2013.01); *F04D 25/0613* (2013.01)

USPC ..... 415/206; 415/204; 415/208.1; 415/211.1; 416/186 R

(58) Field of Classification Search

CPC . F04D 17/16; F04D 29/4206; F04D 29/4213; F04D 29/4226; F04D 29/663; F04D 29/281

USPC ..... 415/119, 204, 206, 208.1, 211.1; 416/185, 186 R, 188, 223 B

See application file for complete search history.

(56) References Cited

U.S. PATENT DOCUMENTS

| | | | | |
|---|---|---|---|---|
| 4,432,694 | A * | 2/1984 | Kuroda et al. | 416/186 R |
| 5,352,089 | A * | 10/1994 | Tokunaga et al. | 415/206 |
| 2006/0222491 | A1 * | 10/2006 | Shimada | 415/206 |
| 2008/0118345 | A1 * | 5/2008 | Choi et al. | 415/58.4 |

FOREIGN PATENT DOCUMENTS

JP 63-289295 A 11/1988

* cited by examiner

*Primary Examiner* — Christopher Verdier

(74) *Attorney, Agent, or Firm* — Carrier Blackman & Associates, P.C.; Joseph P. Carrier; William D. Blackman

(57) ABSTRACT

A centrifugal fan is provided. The centrifugal fan is configured such that an impeller having a plurality of blades along a circumferential direction and disposed between a disk-shaped main plate and an annular shroud is accommodated in a casing, and that air suctioned from a suction opening is discharged outward in a radial direction of the impeller. One end of each of the blades is supported by the main plate, and the other end of each of the blades is supported by the annular shroud. The annular shroud includes a curved surface formed from an outer circumferential edge toward a center thereof, and a cylindrical part connected to the curved surface at a center side. An upper end of the cylindrical part of the annular shroud passes through an opening of the casing and protrudes from the casing, and the upper end of the cylindrical part has a bell mouth shape.

2 Claims, 7 Drawing Sheets

RELATED ART

RELATED ART

RELATED ART

RELATED ART

CENTRIFUGAL FAN

BACKGROUND OF THE INVENTION

1. Field of the Invention

The present invention relates to a centrifugal fan, and more particularly, to a centrifugal fan which can reduce noise at air blowing.

2. Description of the Related Art

A centrifugal fan is configured by providing an impeller in a scroll casing. The impeller has a plurality of blades disposed around a rotation shaft of a motor, and the scroll casing has a suction opening and a discharge opening. Air suctioned from the suction opening flows from the center of the impeller into between the blades, and is discharged outward in the radial direction of the impeller by a fluid force due to a centrifugal action from the rotation of the impeller. The air discharged from the outer circumference of the impeller passes through the scroll casing to become high-pressure air, and is discharged from the discharge opening.

This centrifugal fan is widely used for cooling, ventilation, and air conditioning in home appliances, OA devices, and industrial equipment, an air blower for a vehicle, and the like. However, due to the configuration of the centrifugal fan, the air blowing performance and noise are significantly influenced by the blade shape of the impeller and the shape of the scroll casing.

Therefore, there has been proposed a centrifugal fan which optimizes a blade shape of an impeller to reduce noise (see, for example, JP-A-S63-289295).

FIG. 8 is a plan view illustrating a centrifugal fan described in JP-A-S63-289295, and FIG. 9 is a perspective view illustrating an impeller of FIG. 8. The impeller 120 of the centrifugal fan includes a plurality of blades 123 installed between a main plate 121 and a sub plate 122, the outer circumferential side of the blades 123 rotates with delay from the inner circumferential side of the blades 123 in the rotation direction of the impeller 120. A scroll casing 127 is attached to the impeller 120 to blow air.

The blown air is suctioned from the suction opening 140 of the impeller 120, discharged from the outer circumference of the impeller 120 by the fluid force due to the centrifugal action of the blades 123 of the impeller 120, guided to a discharge opening 141 of the scroll casing 127 along the scroll casing 127 surrounding the outer circumference of the impeller 120, and discharged outside. In this blade configuration in which the outer circumferential side of the blades 123 rotates with delay from the inner circumferential side of the blades 123 in the rotation direction of the impeller 120, the blades are backward inclined blades and have a curved blade shape inclined backward in the rotation direction. The centrifugal fan having that blade shape is generally called a turbofan.

In the turbofan shown in FIG. 8, the plurality of blades 123 are interposed between the main plate 121 and the sub plate 122 having the same outside diameter, and the blades have trailing edges cut such that a blade arc 135 on the main plate side is shorter than a blade arc 134 on the sub plate side. Therefore, a time difference is generated between a time when each trailing edge 131 located on the main plate side crosses a tongue part 129 of the casing and a time when a corresponding trailing edge 132 located on the sub plate side crosses the tongue part 129 of the casing, such that pressure fluctuation occurring when the blades 123 cross the tongue part 129 of the casing is dispersed temporally, and sound generating energy is dispersed, so that generation of noise can be suppressed.

The turbofan described in JP-A-S63-289295 realizes suppression of noise when air is blown, by the shape of the blades 123. However, when air discharged from the outer circumference of the impeller collides with an inner wall surface of the scroll casing 127, a portion of the air flows back to the suction opening 140 so as to interfere with air suctioned into the suction opening 140, so that disturbance occurs in the air flow at the suction opening 140, and the disturbance of the air flow causes noise. Moreover, the disturbance of the air flow reduces an air flow in the suction opening 140, and thus the air blowing performance is deteriorated.

SUMMARY OF THE INVENTION

The present invention has been made in view of the above circumstances, and it is an aspect of the present invention to provide a centrifugal fan which can reduce noise and improve an air blowing performance by optimizing a configuration in the vicinity of a suction opening.

The inventor of the present invention has analyzed a relation between a configuration of the vicinity of a suction opening and noise in a centrifugal fan. As a result, the inventor has found that it is possible to reduce noise of the centrifugal fan and improve the air blowing performance of the centrifugal fan, particularly by optimizing the configuration of the vicinity of the suction opening.

Specifically, according to an illustrative embodiment, there is provided a centrifugal fan configured such that an impeller having a plurality of blades along a circumferential direction and disposed between a disk-shaped main plate and an annular shroud is housed in a casing, and that an air suctioned from a suction opening is discharged outward in a radial direction of the impeller by a centrifugal force due to a rotation of the impeller, and thereby discharging the air from a discharge opening of the casing. One end of each of the blades is supported by the main plate, and the other end of each of the blades is supported by the annular shroud. The annular shroud includes a curved surface formed from an outer circumferential edge toward a center thereof, and a cylindrical part connected to the curved surface at a center side. An upper end of the cylindrical part of the annular shroud passes through an opening of the casing and protrudes from the casing. The upper end of the cylindrical part has a bell mouth shape.

According to the above configuration, since the upper end of the cylindrical part of the annular shroud passes through the opening of the casing and protrudes from the casing and the upper end of the cylindrical part has the bell mouth shape, it is possible to stabilize the air suctioned into the suction opening, and to reduce blowback according to the back flow by the bent part of the upper end of the cylindrical part. As a result, disturbance of the air does not occur in the vicinity of the suction opening. Therefore, it is possible to provide a centrifugal fan which can reduce noise and improve air blowing performance.

DETAILED DESCRIPTION

Figure 1:
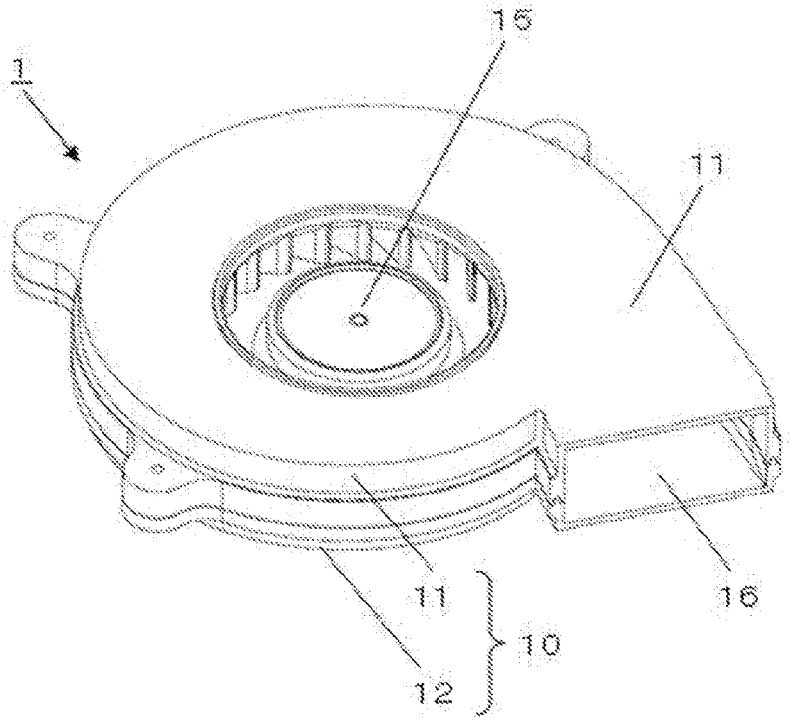
FIG. 1 is a perspective view illustrating a centrifugal fan according to an illustrative embodiment of the present invention.
Figure 3:
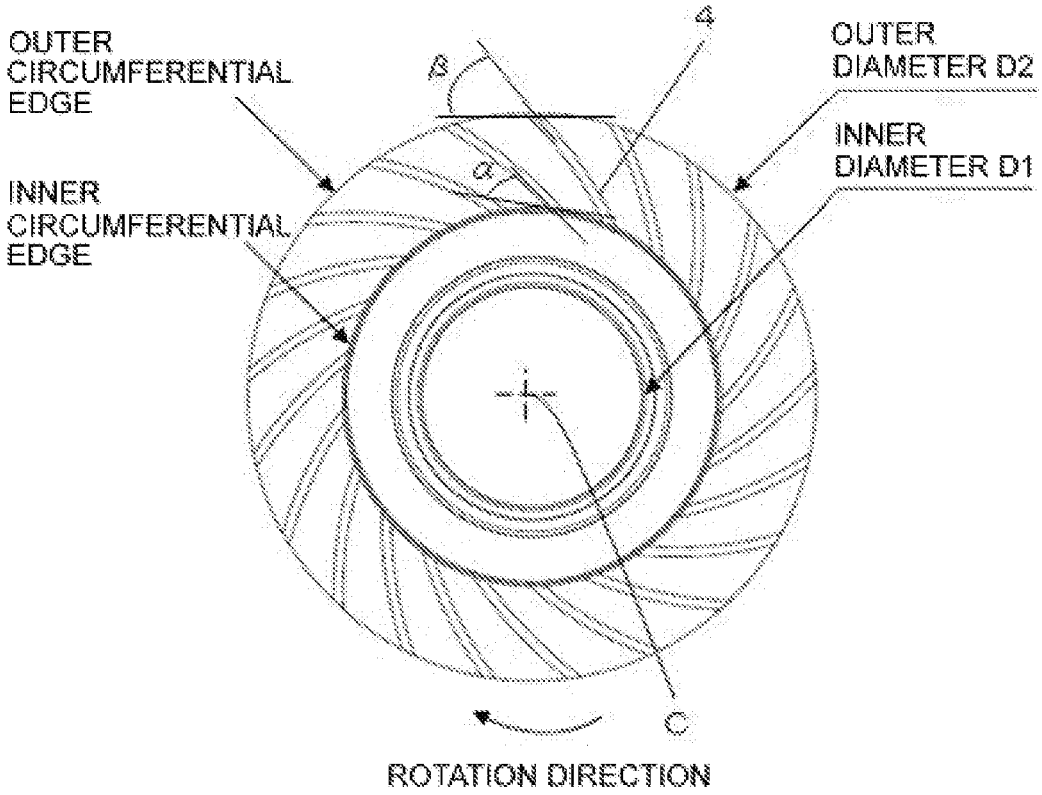
FIG. 3 is a view illustrating a blade configuration of an impeller shown in FIG. 1.
Figure 4:
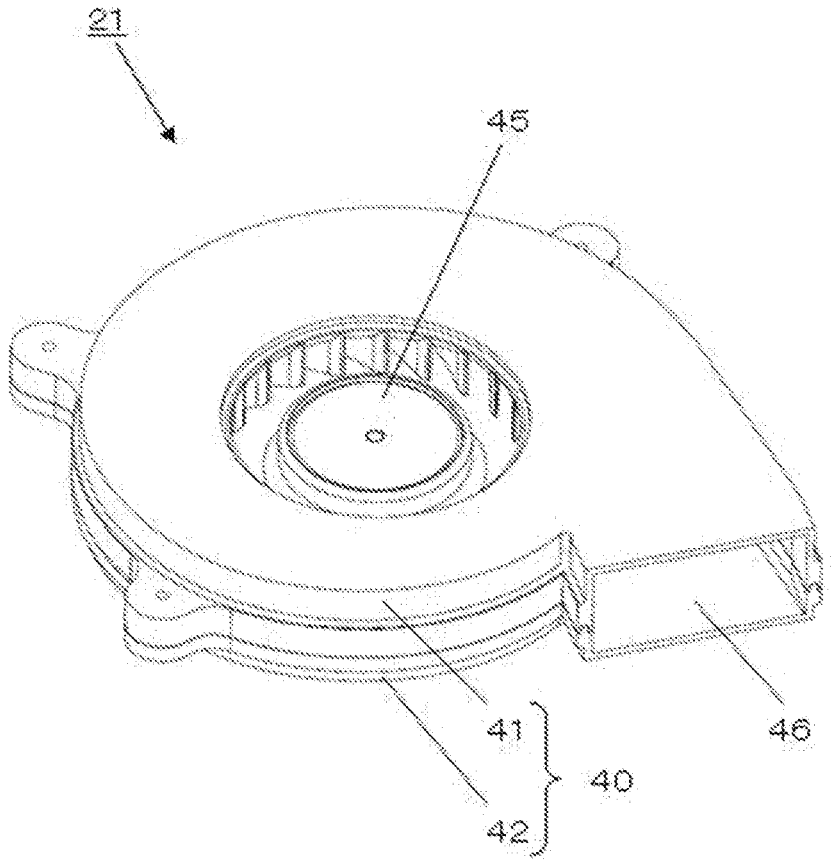
FIG. 4 is a perspective view illustrating a centrifugal fan having a related-art configuration.

Hereinafter, illustrative embodiments of the present invention will be described with reference to the accompanying drawings. FIG. 1 is a perspective view illustrating a centrifugal fan according to an illustrative embodiment of the present invention, FIG. 2 is a cross-sectional view illustrating the centrifugal fan shown in FIG. 1, FIG. 3 is a perspective view illustrating an impeller shown in FIG. 1, FIG. 4 is a perspective view illustrating a centrifugal fan having a related-art configuration, and FIG. 5 is a cross-sectional view illustrating the centrifugal fan shown in FIG. 4.

Figure 5:
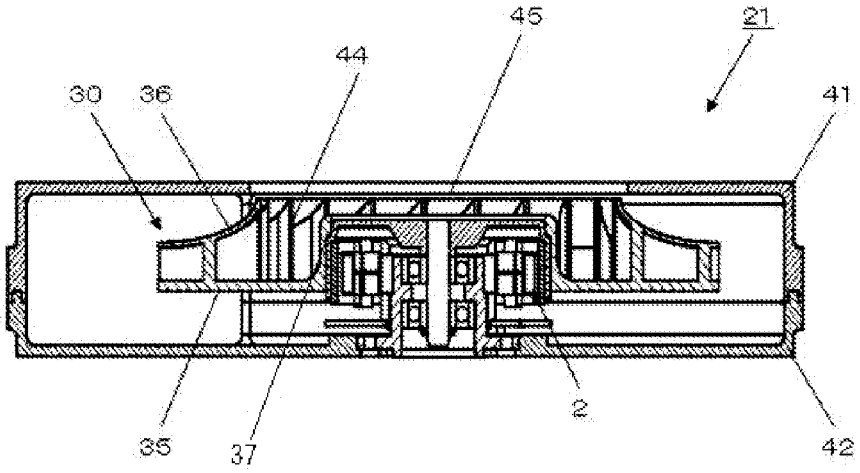
FIG.5 RELATED ART
FIG. 5 is a cross-sectional view illustrating the centrifugal fan shown in FIG. 4.

As shown in FIG. 5, a related-art centrifugal fan 21 includes an impeller 30 having a plurality of blades 44 disposed therein, and a scroll casing 40 which houses the impeller 30, and the impeller 30 is rotated by a motor 2. The scroll casing 40 includes an upper plate 41 and a lower plate 42 and is configured to discharge air suctioned from a suction opening 45 from a discharge opening 46.

The impeller 30 is configured such that the plurality of blades 44 are disposed at an equal interval in a circumferential direction, and that one end of each of the blades is supported by a main plate 35 and the other end of each of the blades is supported by an annular shroud 36. The plurality of blades 44 are interposed between the main plate 35 and the annular shroud 36. The annular shroud 36 has a curved surface formed from the outer circumferential edge portion toward a center thereof. The main plate 35 is disk-shaped, and has a cup-shaped boss part 37 at the center thereof. The blades 44 have a curved shape with a predetermined curvature and all have a same shape. A rotor part of the motor 2 is coupled to an inner surface of the cup-shaped boss part 37 such that the impeller 30 rotates according to the rotation of the rotor part.

Figure 2:
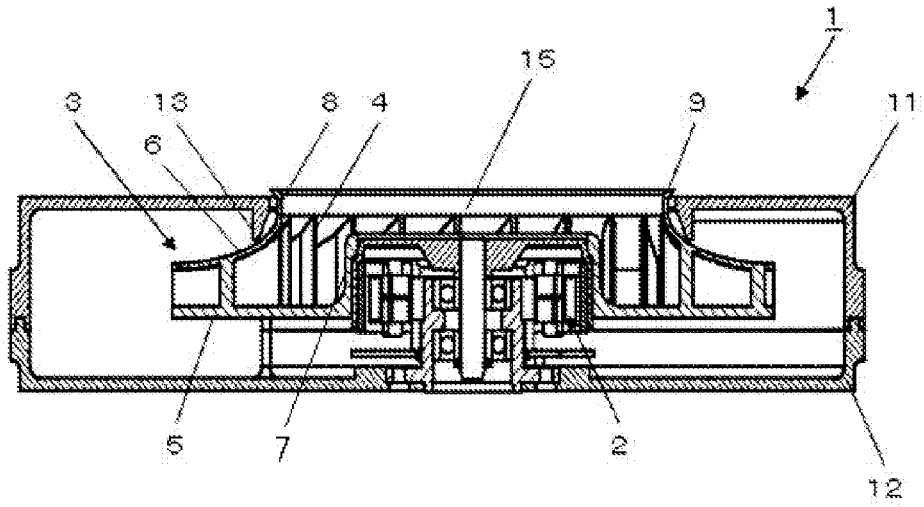
FIG. 2 is a cross-sectional view illustrating the centrifugal fan shown in FIG. 1.

FIGS. 1 and 2 are views illustrating a centrifugal fan 1 according to an illustrative embodiment of the present invention, the centrifugal fan 1 includes an impeller 3 having a plurality of blades 4 disposed therein, and a scroll casing 10 which houses the impeller 3, and the impeller 3 is rotated by a motor 2. The scroll casing 10 has the substantially same configuration as the related-art configuration, includes an upper plate 11 and a lower plate 12, and is configured to discharge air suctioned from a suction opening 15 from a discharge opening 16.

As shown in FIG. 2, an upper end of a cylindrical part 8 of an annular shroud 6 of the impeller 3 passes through an opening formed at a center of the upper plate 11 of the casing 10 so as to protrude upward in an axial direction. Further, the upper end of the cylindrical part 8 has a bell mouth shape. An annular protrusion 13 is formed at the periphery of the opening of the upper plate 11 of the casing 10 to protrude downward in the shaft direction such that the protrusion 13 opposes the annular shroud 6 with a predetermined distance.

Similarly to the impeller 30 of the related-art centrifugal fan 21, the impeller 3 is configured such that the plurality of blades 4 are disposed at an equal interval in a circumferential direction, and that one end of each of the blades is supported by a main plate 5, and the other end of each of the blades is supported by the annular shroud 6. The plurality blades 4 are interposed between the main plate 5 and the annular shroud 6. The annular shroud 6 includes a curved surface formed from an outer circumferential edge toward a center thereof, and the cylindrical part 8 connected to the curved surface at a center side. The upper end of the cylindrical part 8 is bent outward in the radial direction to form a bent part 9 such that the upper end of the cylindrical part 8 has the bell mouth shape. The main plate 5 is disk-shaped, and has a cup-shaped boss part 7 at a center thereof. The blades 4 have a curved shape with a predetermined curvature and all have a same shape. A rotor part of the motor 2 is coupled to an inner surface of the cup-shaped boss part 7, and the impeller 3 rotates according to the rotation of the rotor part. That is, the impeller 3 of the centrifugal fan according to the illustrative embodiment of the present invention is different from the impeller 30 of the related-art centrifugal fan in that the cylindrical part 8 connected to the curved surface of the annular shroud 6 is formed at a center side, and in that the upper end portion of the cylindrical part 8 is bent outward to form the bent part 9.

FIG. 3 is a view illustrating a configuration of the blades 4 of the impeller 3 shown in FIG. 1, an outer diameter D2 of the impeller 3 is 120 mm, an inner diameter D1 of the impeller 3 is 50 mm, the blades 4 are disposed at an equal pitch in the circumferential direction, and the number of blades 4 is set at 21. An outlet angle $\beta$of each blade 4 is set to 45 degrees if an angle formed by a tangential line of a circle having a radius equal to a line segment connecting the center C of a rotation shaft of the fan and the outer circumferential edge of each of the blades 4 and the corresponding blade 4 is defined as the outlet angle. An inlet angle $\alpha$is set to 40 degrees if an angle formed by a tangential line of a circle having a radius equal to the line segment connecting the center C of the rotation shaft of the fan and the inner circumferential edge of each of the blades 4 and the corresponding blade 4 is defined as the inlet angle $\alpha$. That is, the blades 4 of the impeller 3 are backward inclined blades, so that the fan is a kind of a turbofan.

The configuration of the blades 44 of the impeller 30 of the related-art centrifugal fan 21 shown in FIG. 5 has the same configuration as the configuration shown in FIG. 3.

Figure 6:
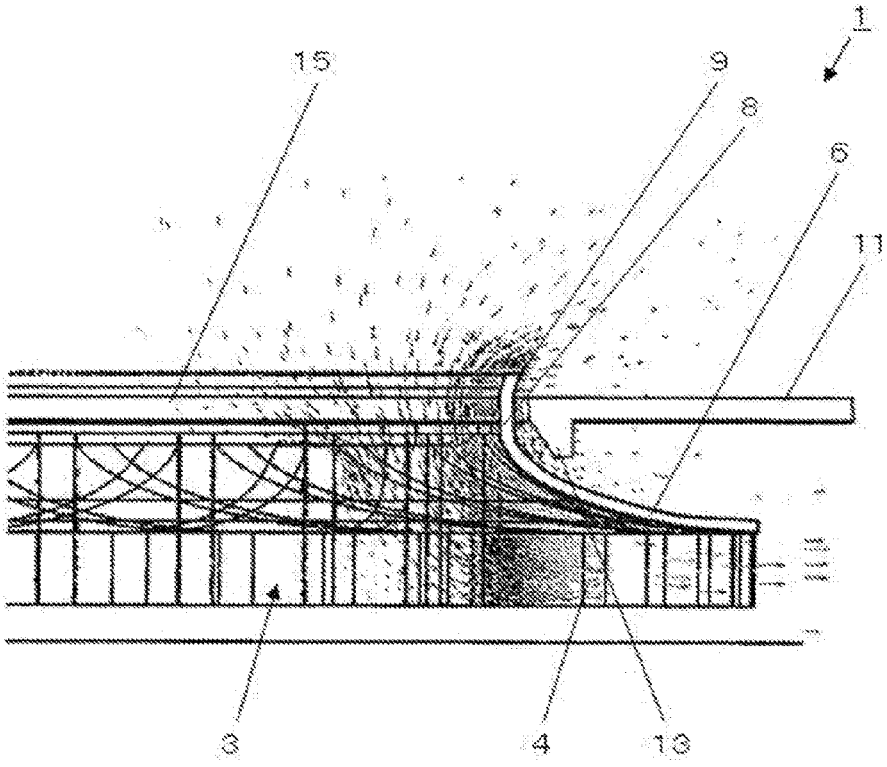
FIG. 6 is a partial view illustrating a simulation result of an air flow in the centrifugal fan according to the illustrative embodiment shown in FIG. 2.
Figure 7:
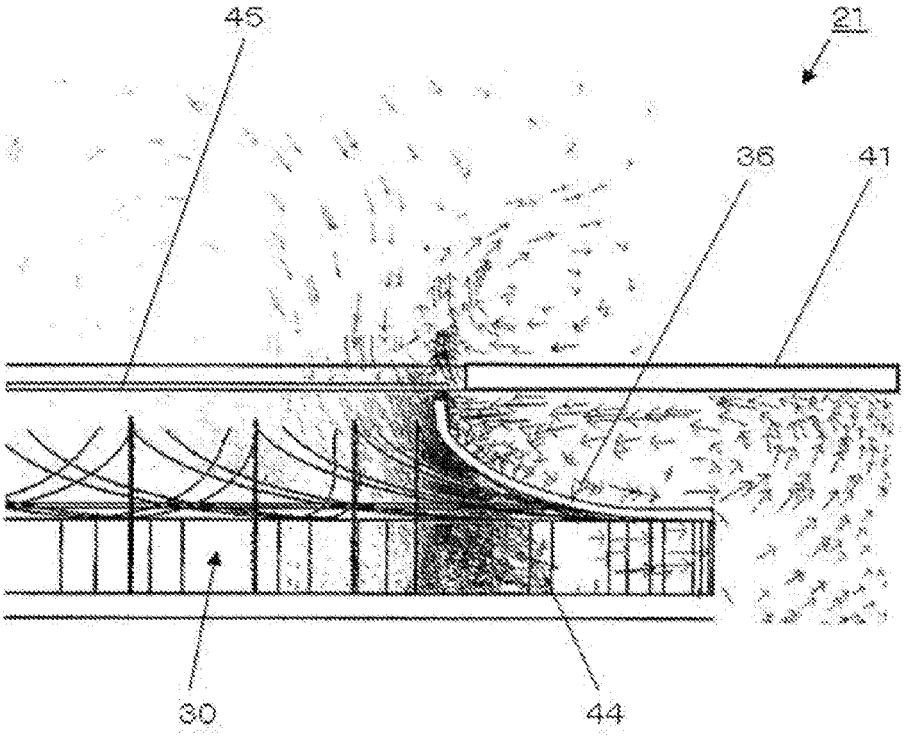
FIG. 7 is a partial view illustrating a simulation result of an air flow in the related-art centrifugal fan shown in FIG. 5.
Figure 8:
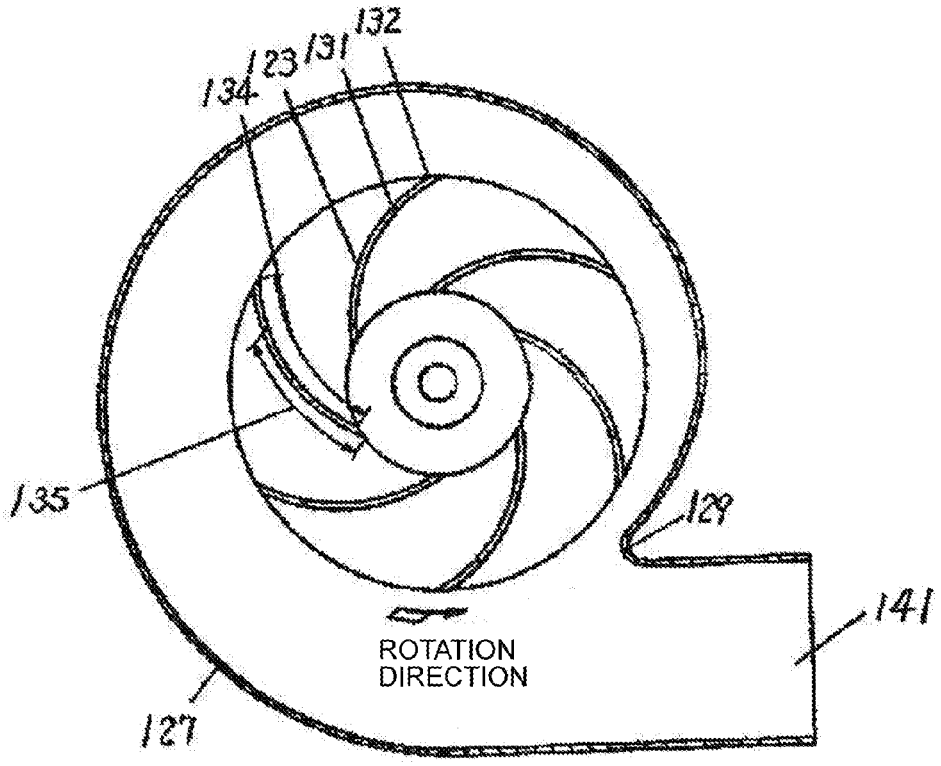
FIG. 8 is a view illustrating a related-art centrifugal fan.
Figure 9:
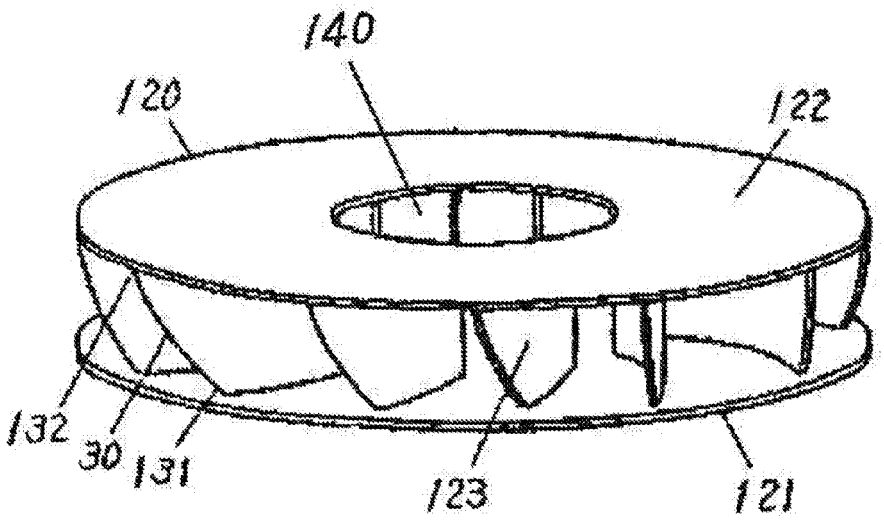
FIG. 9 is a cross-sectional view illustrating a portion of the related-art centrifugal fan shown in FIG. 8.

FIG. 6 is a view illustrating a simulation result of an air flow in the centrifugal fan 1 according to the illustrative embodiment of the present invention shown in FIG. 1 and is a view illustrating a simulation result of an air flow in the vicinity of the suction opening 15, and FIG. 7 is a partial view illustrating a simulation result of an air flow in the vicinity of the suction opening 45 in the related-art centrifugal fan 21.

FIGS. 6 and 7 show the simulation results of the air flows when a static pressure is 750 Pa.

In the related-art centrifugal fan 21 shown in FIG. 7, as shown in FIGS. 4 and 5, the annular shroud 36 has the curved surface formed from the outer circumferential edge toward the center. However, an upper end of the curved surface does not protrude from the upper plate 41 of the casing 40, and the upper end of the curved surface does not have a bell mouth shape. Therefore, as shown in FIG. 7, in the related-art centrifugal fan 21, air suctioned from the suction opening 45 according to the rotation of the impeller 30 is suctioned into between the blades of the impeller 30, and then, the suctioned air flows back between the annular shroud 36 and the upper plate 41 of the casing to the suction opening 45. That is, air is suctioned into between the blades 44, and then, a portion of the air colliding with the inner wall of the casing 40 does not flow toward the discharge opening 46 and flows back to the suction opening 45, so that the air flowing back interferes with air suctioned into the suction opening 45.

Since the air suctioned into the suction opening 45 collides and interferes with the air flowing back, disturbance occurs in the air in the vicinity of the suction opening 45, such that a vortex is generated in the suction opening 45 since the air suctioned from the outside into the suction opening 45 collides with the flowing back air. As a result, the disturbance of the air in the suction opening 45 occurs such that noise is generated and the air suctioned into the suction opening 45 is significantly reduced so as to significantly reduce an air flow.

In contrast, in the centrifugal fan 1 according to the illustrative embodiment of the present invention, as shown in FIG. 6, a portion of the air suctioned from the suction opening 15 into between the blades 4 according to the rotation of the impeller 3 passes between the annular shroud 6 and the upper plate 11 of the casing 10 and flows back to the outside of the casing 10. However, a back flow is significantly suppressed by the annular protrusion 13 opposing the annular shroud 6 with a slight distance, and further a slight back flow is dispersed outward by the bent part 9 of the annular shroud 6, so as not to interfere with the air suctioned into the suction opening 15. Since disturbance of the air does not occur in the vicinity of the suction opening 15, it is possible to reduce noise, and since air suctioned into the suction opening 15 is not disturbed, it is possible to improve the air blowing performance.

As described above, in the centrifugal fan 1 according to the illustrative embodiment of the present invention, since the upper end of the cylindrical part 8 of the annular shroud 6 protrudes from the upper plate 11 of the casing 10 and the upper end portion of the cylindrical part 8 has the bell mouth shape, it is possible to stabilize the air suctioned into the suction opening 15, and to reduce blowback according to the back flow by the bent part 9 of the upper end portion of the cylindrical part 8. As a result, it is possible to provide a centrifugal fan which can reduce noise and improve an air blowing performance.

What is claimed is:

1. A centrifugal fan configured such that an impeller having a plurality of blades along a circumferential direction and disposed between a disk-shaped main plate and an annular shroud is housed in a casing, and that air suctioned from a suction opening is discharged outward in a radial direction of the impeller by a centrifugal force due to a rotation of the impeller, and thereby discharging the air from a discharge opening of the casing, wherein one end of each of the blades is supported by the main plate, and the other end of each of the blades is supported by the annular shroud, wherein the annular shroud includes a curved surface formed from an outer circumferential edge toward a center thereof, and a cylindrical part connected to the curved surface at a center side, and wherein an upper end of the cylindrical part of the annular shroud passes through an opening of the casing and protrudes from the casing, and the upper end of the cylindrical part has a bell mouth shape.

2. The centrifugal fan according to claim 1, wherein an annular protrusion is formed at a periphery of the opening of the casing to protrude downward in an axial direction such that the protrusion opposes the annular shroud with a predetermined distance.

* * * * *